United States Patent [19]

Ruhmann et al.

[11] Patent Number: 4,608,931

[45] Date of Patent: Sep. 2, 1986

[54] FILAMENT WOUND RAILWAY HOPPER CAR

[75] Inventors: Douglas C. Ruhmann, Brentwood; Ralph A. Britton, St. Charles; James D. Mundloch, Florissant; Frederick E. Vorwerk, St. Peters, all of Mo.

[73] Assignee: ACF Industries, Incorporated, Earth City, Mo.

[21] Appl. No.: 326,796

[22] Filed: Dec. 3, 1981

[51] Int. Cl.[4] ..... B61D 7/00

[52] U.S. Cl. ..... 105/248; 105/358

[58] Field of Search ..... 105/248, 406 R, 247, 105/358, 360; 264/257; 156/91, 92, 169, 174; 220/3, 1.5; 428/57, 174, 312.6, 438

[56] References Cited

U.S. PATENT DOCUMENTS

| | | | |
|---|---|---|---|
| 2,460,181 | 1/1949 | Marshall | 156/91 X |
| 2,616,758 | 11/1952 | Meyers | 105/248 X |
| 3,107,195 | 10/1963 | Stegler et al. | 428/57 |
| 3,112,234 | 11/1963 | Krupp | 156/169 |
| 3,158,383 | 11/1964 | Anderson et al. | 105/360 X |
| 3,316,337 | 4/1967 | North | 264/257 X |
| 3,339,499 | 9/1967 | Charles et al. | 105/248 |
| 3,458,238 | 7/1969 | Mowatt-Larssen | 105/248 |
| 3,490,387 | 1/1970 | Halcomb | 105/248 |
| 3,583,331 | 6/1971 | Mowatt-Larssen | 105/248 |
| 3,605,635 | 9/1971 | Stark | 105/248 |
| 3,921,537 | 11/1975 | Fleshman et al. | 105/248 |
| 4,168,665 | 9/1979 | Needham et al. | 105/406 R X |
| 4,230,048 | 10/1980 | Gordon et al. | 105/248 |
| 4,271,649 | 6/1981 | Belanger | 428/438 X |
| 4,292,898 | 10/1981 | Gordon et al. | 105/248 X |
| 4,466,356 | 8/1984 | Messersmith et al. | 105/358 |

FOREIGN PATENT DOCUMENTS

| | | | |
|---|---|---|---|
| 723535 | 2/1955 | United Kingdom | 156/92 |

*Primary Examiner*—Robert B. Reeves
*Assistant Examiner*—Donald T. Hajec
*Attorney, Agent, or Firm*—Polster, Polster and Lucchesi

[57] ABSTRACT

A railway hopper car (200) includes a filament wound fiberglass car body having side walls (202, 204) integral with a roof (208), preferably also formed of a filament wound fiberglass. The fiberglass side walls are connected to longitudinally extending side sills (220, 222) preferably made of steel which extend along each side of the car. The car body includes laterally spaced top sills (226) preferably of fiberglass connected to the fiberglass sides. The car is divided into a plurality of hoppers by transverse bulkheads (244, 246, 248) which are conveniently formed of sandwich panels of wood or wood fibers with fiberglass facings. Hopper slope sheets (258, 260, 262, 264, 266, 268) and end slope sheets (304, 306) are also conveniently formed of sandwich panels of wood or wood fibers with fiberglass facings. Metallic stub sills (282) are located at each end of the car and a metallic shear plate (292) at each end of the car extends transversely of the car to transfer coupler loads from the stub sill to the side sills. The fiberglass body is cut away at lower end portions (340) to avoid direct engagement of the car body with the stub sill and the shear plate. The coupler loads are transferred through the shear plate (292) to the side sills (220, 222) and direct loading of the fiberglass car body with coupler loads is substantially reduced.

7 Claims, 19 Drawing Figures

FILAMENT WOUND RAILWAY HOPPER CAR

BACKGROUND OF THE INVENTION

In U.S. Pat. No. 4,292,890 a railway hopper car is disclosed in which the car body is formed by passing "E" type glass filaments through a liquid polyester resin (isophthalic acid and propylene glycol) containing styrene monomer for unsaturation to form flat bands which are wound about a mandrel in a helical winding pattern at an angle of ±30° to the longitudinal axis.

However, in this construction the car body is subjected directly to the coupler loads applied to the coupler and which are transferred into the center sill.

In application Ser. No. 326,797 filed Dec. 3, 1981 now abandoned assigned to the same assignee as the present application, a filament wound vessel is disclosed in which at least one layer of resin impregnated glass fiber rovings is formed into bands, and hoop wound upon a rotating mandrel in a direction approximatley 90° to the longitudinal axis of the mandrel. The rovings are thus orientated at approximately 90° to the vessel axis. Next, at least one layer of weft unidirectional fabric comprising strands of glass fibers woven with a suitable thread in the warp direction into a relatively wide band, is hoop wound upon the first hoop wound roving layer and is applied with a resin binder. This results in the woven glass fibers being orientated along the longitudinal axis of the vessel at approximately 0° Next, at least one band of resin coated rovings is helically wound at an angle of from about +40° to about +60°, or −40° to about −60° to the longitudinal axis of the vessel (counterclockwise rotation being positive). Preferably, at least one additional band of resin coated rovings is helically wound in a direction opposite to the first helically wound band. Preferably, at least one layer of weft woven fabric, woven with a suitable thread in a warp direction is hoop wound with the glass strands extending along the longitudinal axis of the vessel upon the helically wound bands of rovings. Preferably at least one additional band of resin coated rovings are hoop wound in a direction approximately 90° to the longitudinal axis of the vessel.

As is described in greater detail in said application Ser. No. 326,797, this construction results in a filament wound vessel having quasi-isotropic properties of a magnitude sufficient to carry lading loads encountered in railway hopper car applications.

However, even with this improved filament wound construction, it is not believed the fiberglass body is sufficiently strong and resistant to buckling to directly react coupler loads such as those resulting from impacts in switching yards and squeeze loads encountered on inclines over an extended period of car life.

OBJECTS OF THE INVENTION

One object of the present invention is to provide a filament wound fiberglass railway hopper car in which direct transmission of the coupler loads to the fiberglass car body is substantially reduced.

Another object of the present invention is to provide a filament wound railway hopper car which utilizes light weight side sheets as compared to steel.

Another object is to provide a corrosion resistant railway hopper car.

Another object of the present invention is to provide a lightweight railway covered hopper car having a filament wound fiberglass car body with quasi-isotropic properties resulting from the winding technique described in application Ser. No. 326,797 and conventional metallic stub sills and shear plates. This covered hopper car design provides a structure which is capable of withstanding both the lading loads and train action impact and squeeze loads encountered in service.

Another object of the present invention is to provide a filament wound railway covered hopper car which utilizes lightweight, fiberglass slope sheets and bulkheads which further reduces the cars empty weight when compared to a conventional steel covered hopper car.

Other objects will be apparent from the following description and drawings.

SUMMARY OF THE INVENTION

In accordance with one feature of the present invention a railway covered hopper car includes filament wound fiberglass side walls integral with a covered hopper car roof.

In accordance with another feature, the fiberglass side walls are connected to longitudinally extending side sills preferably metallic which extend along each side of the car. The car body sides preferably include laterally spaced top sills also preferably made of fiberglass connected to the fiberglass sides. Optional vertical and longitudinal side stiffeners located between the side sill and top sill may be provided. Optional roof sheet stiffeners may also be provided if the roof is made of fiberglass.

In accordance with another feature of the invention, the car is divided into a plurality of hoppers by transverse sandwich panel bulkheads which are conveniently formed of wood or wood fibers with fiberglass facings. Hopper slope sheets and end slope sheets are also conveniently formed of the same material. The fiberglass sides are preferably joined to hopper slope sheets and to the end floor sheets at least partially by lap joint bonding.

Metallic stub sills are located at each end of the car and a metallic shear plate at each end of the car extends transversely of the car to transfer coupler loads from the stub sill to the side sills.

In accordance with another feature of the invention, the fiberglass body is cut away at lower end portions such that direct engagement of the car body with the stub sill and shear plate is avoided. At least a portion of the coupler loads are transferred through the shear plate to the side sills and direct loading of the fiberglass car body with coupler loads is substantially reduced.

In accordance with another feature of the invention, a method of assembling a filament wound hopper car includes filament winding fiberglass side walls integral with a filament wound fiberglass roof. The fiberglass side walls are connected to longitudinally extending side sills which extend along each side of the car. Stub center sills are located at each end of the car. A shear plate at each end of the car is located above each stub sill and extends transversely of the car to transfer coupler loads from the stub sill to the side sills. The fiberglass body is shaped at lower end portions such that the coupler loads are transferred through the shear plate to the side sills and direct loading of the car body with coupler loads is substantially reduced.

In accordance with another feature of the invention, a method of fabricating a filament wound railway hopper car includes filament winding at least one layer of fiberglass upon a rotating mandrel to form a fiberglass body; cutting the filament wound fiberglass body into at least two body portions; removing the thus cut body portions from the mandrel; cutting a desired hopper pattern on each of the removed body portions; connecting the upper portions of end slope sheets and transverse bulkheads to at least one of the body portions; connecting hopper slope sheets and the lower portion of end slope sheets to said one body portion; connecting said other body portion to said transverse bulkheads, hopper slope sheets and to said end slope sheets; connecting said body portions to each other or to a separate fiberglass sheet to form a roof section and to respective side sills extending longitudinally of the car.

In accordance with another feature of the present invention, the filament wound car body acts as a composite box beam and is thus capable of withstanding the combined loading conditions of the lading, and longitudinal and vertical forces encountered in service. The car body may thus be considered to act as a selectively reinforced, generally cylindrically shaped composite box beam with the railway car roof and top sill section acting as a top cap, the car body sides acting as shear webs and the longitudinally extending side sills acting as bottom caps.

As a result, a portion of the longitudinal load applied to the stub sills is transmitted into the shear plate, into a vertical bolster web, into end slope sheets at either end of the car and into end bulkheads. A portion of such load is then transmitted downwardly along the top sill.

Furthermore, under impact loads in transfer yards, and under vertically and longitudinally applied coupler forces such as encountered when the train goes up and down inclines, a turning moment is applied to the vertical bolster web which is transmitted into the end slope sheet, then into the end bulkhead, and then downwardly through end diagonals extending downwardly into the shear plate.

IN THE DRAWINGS

DESCRIPTION OF PREFERRED EMBODIMENTS

Figures 1, 2, 3, 4, 5:
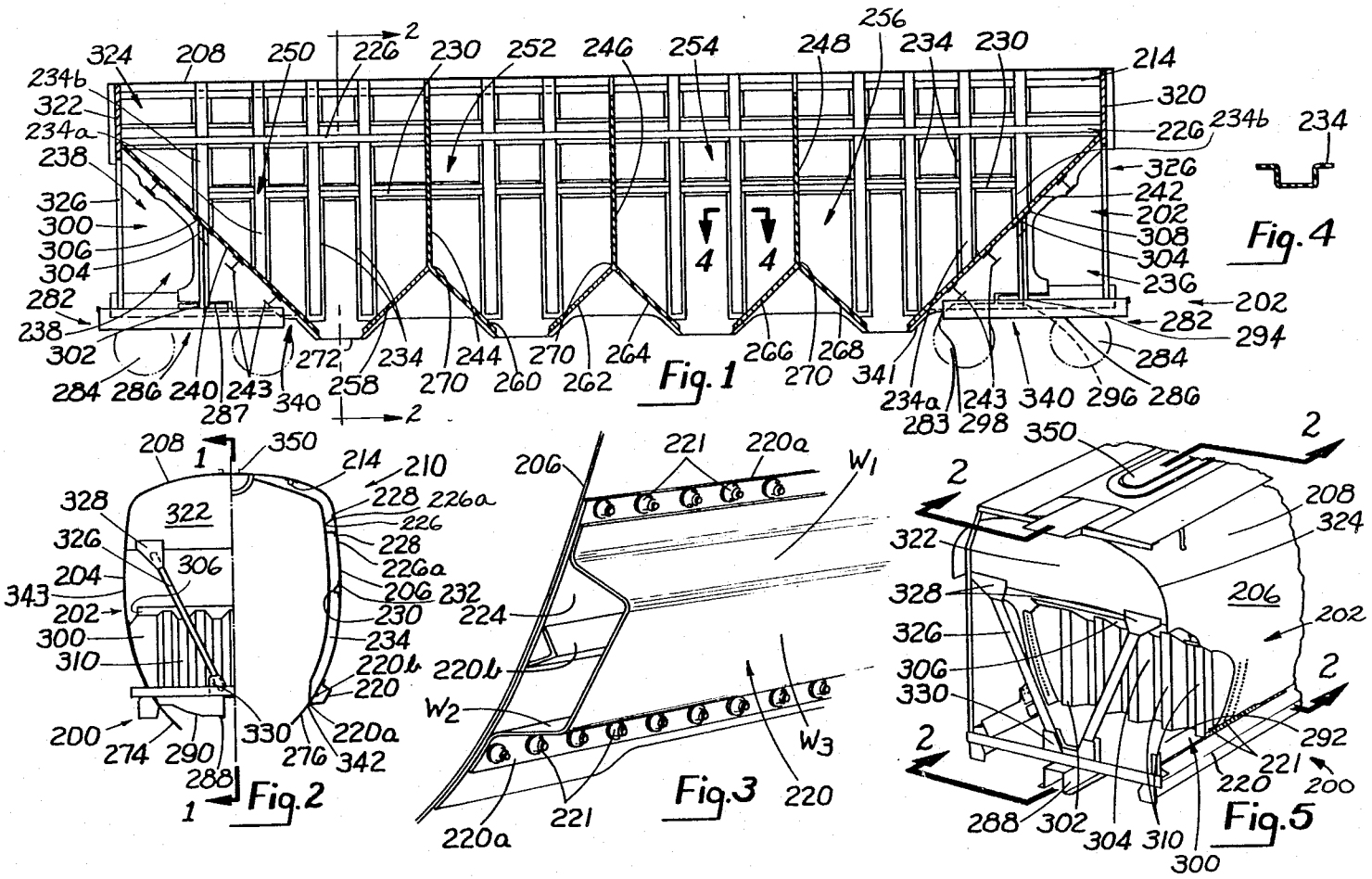
FIG. 1 is a side elevation view of the fiberglass hopper car of the present invention, looking in the direction of the arrows along the line 1—1 in FIG. 2.
FIG. 2 is a combination end view and vertical sectional view of the car illustrated in FIG. 1, looking in the direction of the arrows along the line 2—2 in FIG. 5 and the right hand portion along the line 2—2 in FIG. 1.
FIG. 3 is a perspective view of the side sill illustrated in FIGS. 1 and 2.
FIG. 4 is a horizontal sectional view looking in the direction of the arrows along the line 4—4 in FIG. 1.
FIG. 5 is a perspective view of the end of the fiberglass hopper car illustrated in FIGS. 1 and 2.

A specific embodiment of the present invention will now be illustrated embodying a railway covered hopper car 200, FIGS. 1 and 2. This railway hopper car includes a filament wound body portion 202 constructed in the manner described herein and in greater detail in said application Ser. No. 326,797 filed Dec. 3, 1981, hereby incorporated into the present application by this reference. The filament wound body portion 202 includes curved side walls 204 and 206 which are joined by a curved roof 208 which may be made of fiberglass or metal.

The curved sides 204 and 206 are connected to longitudinally extending side sills 220 and 222. The side sills 220 and 222 are constructed in the same manner and comprise modified hat sections as shown in FIG. 3 including web portions W1 and W2 joined by wall portion W3. Steel, aluminum or fiberglass such as made by the pultrusion process described hereinafter may be used. Side sills 220 and 222 may be provided with reinforcing angles **220*b* to insure that the side sills will adequately carry the longitudinal loads. Metal plates 224 are respectively located between the side sills 220 and 222 and the car body walls 204 and 206. Suitable fasteners such as $\frac{5}{8}''$ Huck bolts 221 hold the flange portions 220*a*, in engagement with the plates 224, and the car respective body sides 204 and 206**.

A pair of longitudinally extending top sills 226 are also provided on either side of the car, one of which is illustrated in FIG. 2. These top sills are also modified hat sections and may be steel or aluminum or may be formed of fiberglass. If made of fiberglass, these top sills will consist of bands of fiberglass woven rovings interspersed with resin layers which may be applied upon a suitable shaped mold. If desired, a layer of unidirectional woven fabric described in greater detail in said Ser. No. 326,797 may be located between the woven roving bands. These top sills 226 are then adhesively bonded to the side sheets 204 and 206 with a commercially available resin or adhesive. Alternatively, the top sills 226 also include flange portions **226*a*, and if made of metal, suitable fasteners 228 may extend through flange portions 226*a*** to hold the top sills in place.

In addition, a pair of optional longitudinal reinforcements or stiffeners 230 made of metal or fiberglass may be provided midway between the side sills 220 and the top sills 226. If made of fiberglass, longitudinal stiffeners 230 are adhesively bonded also to walls 204 and 206. Alternatively, if stiffeners 230 are made of metal suitable fasteners such as Huck bolts 232 may be used to hold these reinforcements in engagement with respective body walls 204 and 206.

Optional roof stiffeners indicated generally at 210 comprise transversely spaced roof stiffeners 214, which extend longitudinally of the car. These roof stiffeners are formed in a manner similar to the top sills 226 and are adhesively bonded to the roof 208.

A plurality of longitudinally spaced vertical reinforcements or stiffeners 234 are also provided in the car (FIG. 1). These vertical stiffeners extend from the side sill up to the roof portion of the car as illustrated in FIG. 2. Stiffeners 234 are hat shaped (FIG. 4) and are formed of fiberglass. Where vertical stiffeners 234 intersect longitudinally extending stiffeners 230; stiffeners 230 are cut away. Where vertical stiffeners intersect top sill 226, stiffeners 234 are coped and stiffeners 234 are adhesively bonded to the top sill 226. Thus an integral structure results. Stiffeners 234 may also extend into the roof as shown in FIG. 2 and are coped around longitudinal stiffeners 214. Vertical stiffeners 234 are foreshortened 234*a*, 234*b* at the end portions of the car 236 and 238. In these end portions, the foreshortened stiffeners 234 are adhesively bonded to respective end floor sheets 240 and 242.

The end floor sheets 240 and 242 are formed of an assembly of balsa wood between fiberglass facings. Alternatively, an assembly of wood fibers bonded and fiberglass facings may be used. These end floor sheets are conveniently $2\frac{1}{4}''$ thick.

Transverse bulkheads 244, 246 and 248 divide the car longitudinally into four hoppers 250, 252, 254, and 256. These transverse bulkheads are conveniently made of the same assembly of wood or wood fibers and fiberglass facings as are end slope sheets 240 and 242. Furthermore, at their lower ends the transverse bulkheads 244, 246 and 248 are each made integral with, for example by lap joint bonding, downwardly extending inclined slope sheets 258, 260, 262, 264, 266 and 268.

End slope sheets 240, 242 and hopper slope sheets 258, 260, 262, 264, 266 and 268 at their opposite ends are integrally connected to the filament wound sides 204 and 206, for example by lap joint bonding indicated at 270.

The end floor sheets 240 and 242 are each reinforced with transversely extending fiberglass wide flange beams indicated at 243. Such beams are conveniently $8'' \times 8''$ and are commercially available, for example from Morrison Molded Fiber Glass Company, Bristol, Va., and are made using the pultrusion process wherein a glass reinforcement is pulled through a die of appropriate shape and simultaneously impregnated with desired resin system.

The lower side portions of the filament wound body 274 276 are attached to an outlet mounting frame which also engages the lower portion of end floor sheets 240 and 242, and hopper slope sheets 258, 260, 262, 264, 266 and 268 to provide a mounting flange 400 (FIG. 6) for the attachment of conventional hopper car outlets 426 of known construction. These outlets 426 fill a large transverse opening 272 between side portions 274 and 276.

The end structure of the car generally follows the teachings of ACF U.S. Pat. No. 3,490,387 granted Jan. 20, 1970. This end structure includes trucks 282 having wheels 284 and a truck bolster 286. An end stub sill 288 is connected to a car body bolster cover plate 290 and to a transversely extending shear plate 292. The shear plate 292 extends longitudinally inwardly from the end of the car to a point above a center plate 294 which rests within a truck bowl 287 integral with the truck bolster 286. A center filler 296 is also located in this portion of the stub sill. The stub sill extends further inwardly to a location 298 generally above the inner wheel axles 283.

End floor sheets 240 and 242 are each supported by a vertical bolster web indicated generally at 300. This bolster web is connected at its lower end 302 to the shear plate 292. It is connected at its upper end 304 to a plate 306 which extends parallel respectively with end floor sheet 240 and 242. Bolts 308 hold the plate 306 in supporting engagement with the end floor sheets 240 and 242. While the bolster web may include a series of reinforcements, transversely spaced across the car as illustrated in FIG. 2 of the above mentioned ACF patent, it is preferred that the bolster web comprise a corrugated construction illustrated in ACF U.S. Pat. No. 4,168,665 and comprising a series of corrugations 310 which are described in greater detail in said U.S. Pat. No. 4,168,665.

End floor sheets 240 and 242 at their upper outer ends are connected to end bulkheads 320 and 322. The end bulkheads 320 and 322 are lap joint bonded respectively to end slope sheets 240 and 242, to the curved roof portion 208, then to curved sides 204 and 206, as indicated generally at 324. End diagonal members 326 extend from the lower ends of end bulkheads 320 and 322 to the shear plate 292. These diagonals are connected to the end bulkheads 320 and 322 with gussets 328 using bonded and bolted fastening techniques. Gussets 330 are also provided to aid in attaching these end diagonals to the shear plate 292. End diagonals 326 are provided to work in concert with the vertical bolster webs 300 in reacting the turning moment applied to the car during coupling impacts in transfer yards as described in greater detail in U.S. Pat. No. 3,490,387.

The car body is cut to form a contour 340 in a manner so as to avoid direct abutment of the car body with the stub sill 288 and shear plate 292. Thus the portion 341 of the filament wound car body is located inboard of shear plate 292 and of the stub sill 288. Portion 342 is outboard on either side of stub sill 288. Portion 343 is above the shear plate 292. This arrangement serves to reduce the tendency of high draft. and squeeze loads encountered in transit and applied to stub sill 288 and shear plate 292 from being concentrated in the fiberglass filament wound body. Side sills 220 and 222 apply shear loads to car body sides 204 and 206 through fasteners 221.

It will be apparent that after conventional hopper car outlets (not shown) are attached to the flange portions 400, that the car can be loaded through hatches 350 provided in the roof. Such lading may be loaded into each of the hoppers 250, 252, 254 and 256.

The fiberglass body is subject to lading loads due to the presence of this lading in each of the hoppers. The mechanical properties of the filament wound body must be such as to be able to withstand these lading loads (See application Ser. No. 326,797 filed Dec. 3, 1981). Furthermore, the filament wound body must be capable of withstanding the shear loads applied by side sills 220 and 222. The longitudinal coupler loads applied down the side sill has a tendency to shear the side walls 204 and 206 away from the side sills 220 and 222. However, the contour 340 (FIG. 13) at each end of the car is such that the coupler loads are not transferred directly into the fiberglass body. Thus a much more lasting car body arrangement is achieved with the construction of the present invention.

A method of assembly of the railway hopper car 200 will now be briefly described.

Figure 11:
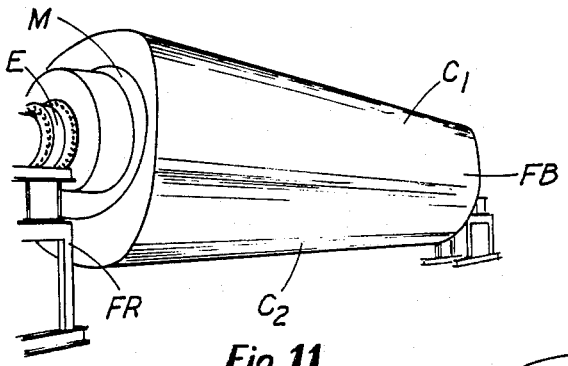
FIG. 11 is a perspective view of a wound vessel formed as a first step in the assembly method of the present invention.
Figure 12:
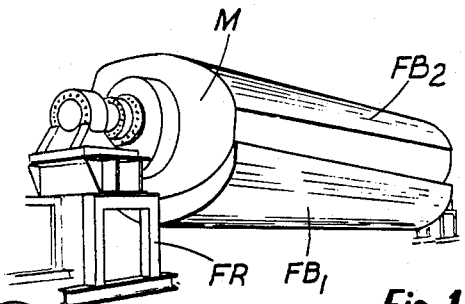
FIG. 12 is a perspective view illustrating removing a filament wound car body side after the body has been cut into separate filament car body sections.
Figure 13:
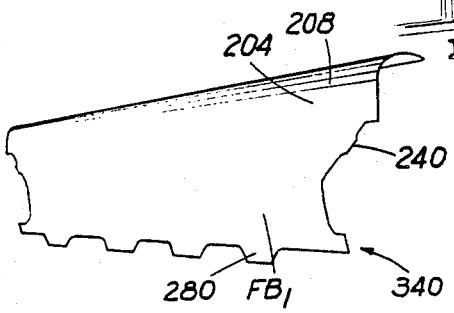
FIG. 13 is a perspective view illustrating the other filament wound car body side formed from the filament wound body formed in FIG. 11.

As is described above in greater detail in application Ser. No. 326,797 filed Dec. 3, 1981, the fiberglass body (FB, FIG. 11) is formed by winding layers of fiberglass upon a mandrel (M) rotated by means of a drive head (E) supported upon a frame (FR). After the fiberglass body has been formed, the body is cut longitudinally in upper and lower portions as indicated at C1 and C2 in FIG. 11. The mandrel is rotated approximately 90° and the fiberglass body is then removed in two sections indicated at FB1, FIG. 12, and FB2 illustrated in FIG. 12. After removal from the mandrel, the fiberglass bodies, FB1 and FB2 are cut into a contour which is appropriate for forming the hopper car of the present invention. As shown in FIG. 13, the section FB1 includes curved side 204 and lower portions 280 on the car body for connection of an appropriate outlet. In addition, the end portions of the bodies FB1 and FB2 are cut away in accordance with the pattern 340 described in greater detail hereinbefore to avoid directly connecting the stub sill 288 (FIG. 18) and the shear plate 292 (FIG. 18) to the fiberglass sections FB1 and FB2. Commercial cutting power tools or a hand saw may be used to obtain the contour.

Figure 14:
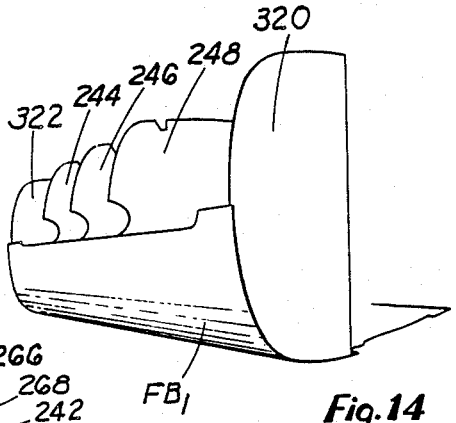
FIG. 14 is a perspective view illustrating attachment of bulkheads to one of the car body sides in an attachment fixture.

End floor sheets 240 and 242, and transverse bulkheads 244, 246 and 248 are lap joint bonded separately to a fiberglass body section, i.e. FB1 in a fixture FI, as shown in FIG. 14.

Figure 15:
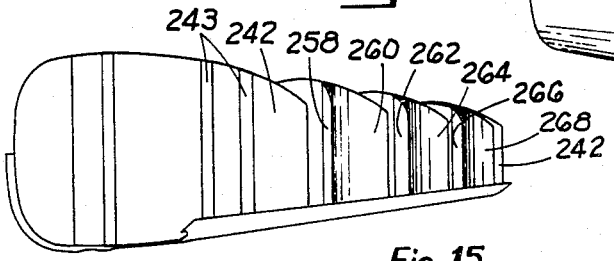
FIG. 15 is a perspective view illustrating attachment of a bulkhead to the car body sides.

As shown in FIG. 15, the hopper slope sheets 258, 260, 262, 264, 266 and 268 are then bonded to the same fiberglass body in the same fixture as above, i.e. FI.

Figure 16:
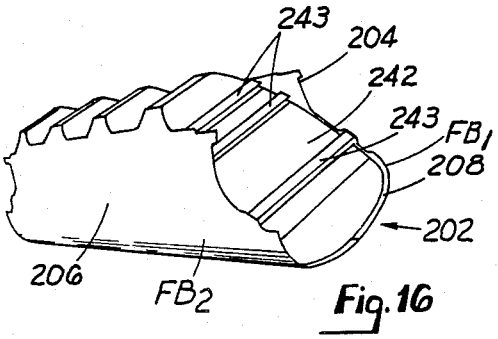
FIG. 16 is a perspective view illustrating the car body with the bulkheads and roof joined together in an integral body.

Next, the upper portions of the end partition sheets 320 and 322 and the upper portions of transverse bulkheads 244, 246, and 248 are bonded to the other of the fiberglass sections, i.e. FB2, see FIG. 16. At this time also, the fiberglass section FB1 is bonded to section FB2 to form an integral body 202. The lower portion of the transverse bulkheads 244, 246, and 248 and the hopper slope sheets 258, 260, 262, 264, 266 and 268 are then bonded to the lower portion of the fiberglass body FB2. As mentioned above, this leaves a space between the lower inner ends 274 and 276 FIG. 2 of the respective fiberglass sections FB1 and FB2 to receive the shear plate 292 and stub sill 288.

Figure 17:
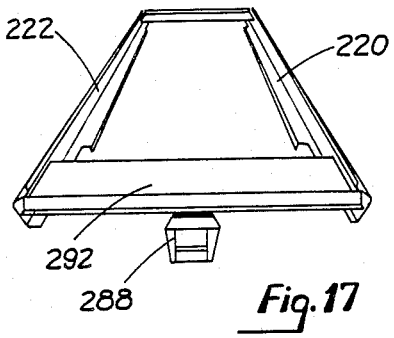
FIG. 17 is a perspective view of the side sill and underframe structure to be used in the present invention.
Figure 18:
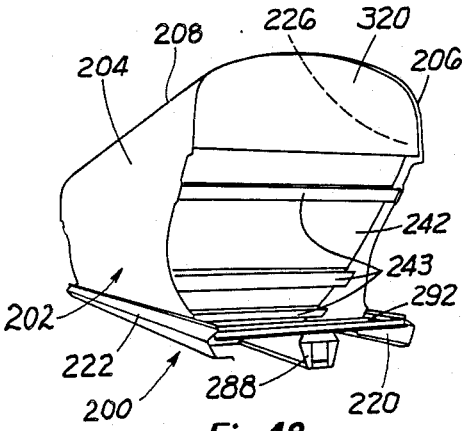
FIG. 18 is a perspective view of the car body located in place upon the underframe illustrated in FIG. 17.
Figure 19:
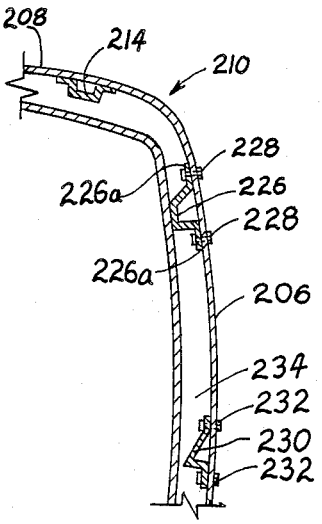
FIG. 19 is an enlarged view of a portion of FIG. 2.

As shown in FIG. 17, the car underframe includes a stub sill 288 and a transversely extending shear plate 292. This shear plate 292 is welded on opposite sides to longitudinally extending side sills 220 and 222. Inboard of the shear plate 292, the car body sides 204 and 206 are integrally connected to the side sills 220 and 222 with Huck bolt fasteners as described in greater detail hereinbefore. FIG. 18 shows the assembled car prior to attachment of the mounting frame and locating trucks under opposite ends. Location of the car body on trucks 282 and attaching the mounting frame to the car body, hopper slope sheets and end slope sheets completes assembly of the hopper car.

Figures 6, 7, 8, 9, 10:
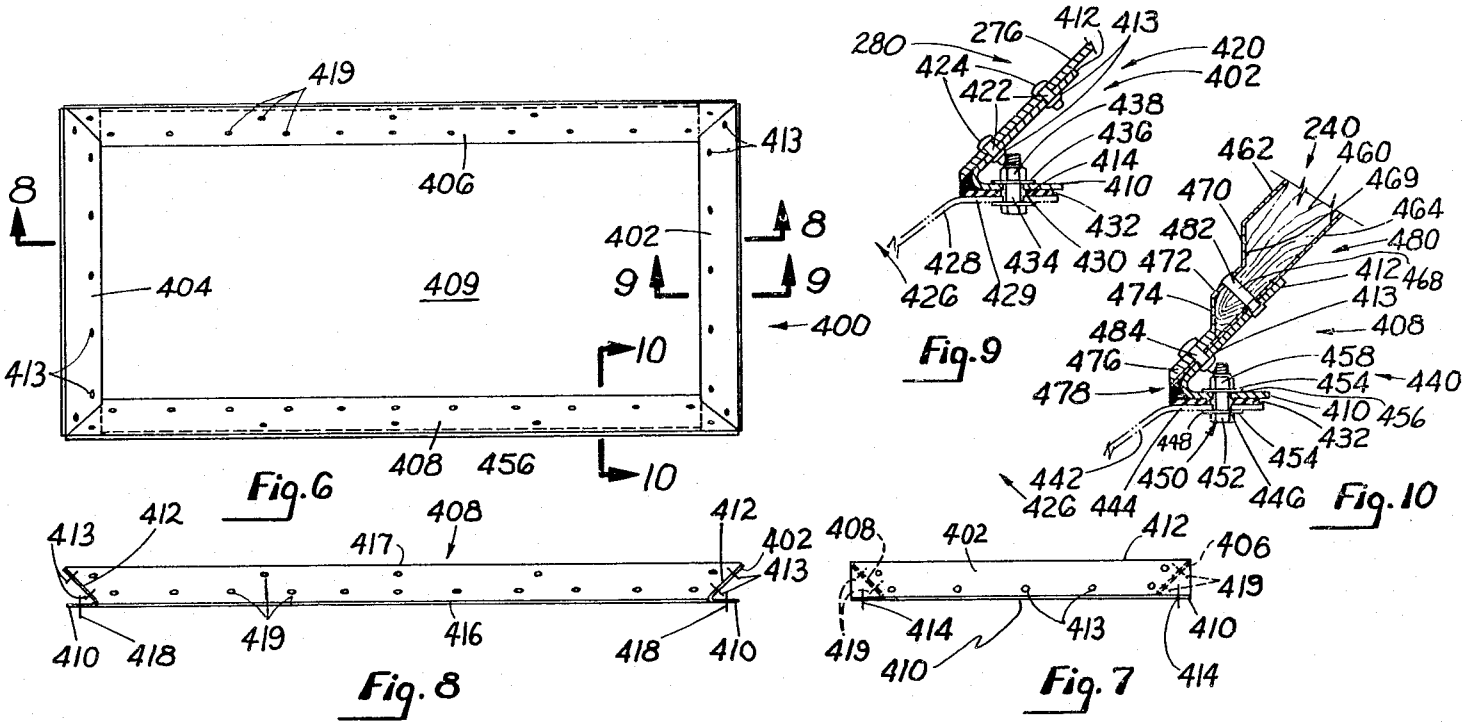
FIG. 6 is a plan view of an outlet mounting flange which may be utilized with the present invention.
FIG. 7 is an end elevation view of FIG. 6.
FIG. 8 is a side elevation view of FIG. 6.
FIG. 9 is a sectional view looking in the direction of the arrows along the line 9—9 in FIG. 6.
FIG. 10 is a sectional view looking in the direction of the arrows along the line 10—10 in FIG. 6.

An outlet mounting frame adapted for attachment to the slope sheets and to the car body portions 274 and 276 is illustrated in FIG. 6 at 400. This outlet mounting frame is generally rectangular and includes short frame members 402 and 404 which extend longitudinally of the car and long frame members 406 and 408 which extend transversely of the car. A large opening 409 is provided in the middle for lading discharge. As shown in FIG. 7, the short frame members 402 and 404 are angle shaped including a generally horizontal leg 410 and an inclined vertical leg 412. Horizontal leg 410 includes openings 414 to attach the mounting frame to an outlet pan flange portion. Similarly, the long frame members 406 and 408 include horizontal legs 416 and inclined vertical legs 417. Openings 418 are provided in the horizontal legs to receive fasteners to mount the flange portion of an outlet upon the outlet frame. Vertical legs 417 include openings 419 for mounting the frame upon flange portion 400. Inclined legs 412 include openings 413 for mounting the frame upon the car body.

FIGS. 9 and 10 illustrate attachment of an outlet with the mounting frame illustrated in FIGS. 6–7. FIG. 9 illustrates attachment of the frame portion 402 to the car body section 276 shown in FIG. 2. The car body attachment means 420 comprises openings 422 provided in the car body 276. Huck blind hole fasteners 424 are then used to attach the car body to the mounting frame portion 402 through the openings 413 in the mounting frame. Alternatively, standard mechanical fasteners can be used in a similar manner to the Huck bolts.

A hopper car outlet of known construction is indicated generally at 426. This outlet includes a pan 428. The construction of the outlet 426 may be of the gravity type, pneumatic type, or gravity pneumatic as is known to those skilled in the art. The outlet per se does not form a part of the present invention. The pan 428 includes a flange portion 429 having an opening therein 430 which aligns with openings 414 provided in the horizontal angle 410. A gasket 432 is placed between the outlet flange portion 429 and the horizontal leg 410. A fastening bolt 434 then extends through the flange portion 429 and the gasket 432 and the washer 436 and a nut 438 are attached on the opposite sides. Car body portion 274 (FIG. 2) is connected to short frame members 404 in the same manner utilizing openings 418 in the horizontal leg 418*a* and openings 419 in the inclined vertical leg 417.

As described hereinabove, end slope sheets 240 and 242 and hopper slope sheets 258, 260, 262, 264, 266 and 268 extend transversely across the car. Frame members 406 and 408 are connected to appropriate adjacent ones of these transverse members.

As an example, attachment of the legs 406 and 408 to end slope sheet 240 and hopper slope sheet 258 will be given. Thus long frame member 406 will be attached to slope sheet 258 and frame member 408 will be attached to the lower portion of end slope sheet 240. FIG. 10 is a section through attachment of end slope sheet 240 to mounting frame member 408. This attachment arrangement is indicated generally at 440. Outlet 426 includes a side slope sheet 442 which includes a flange portion 444 having an attachment opening therein 446. Gasket 432 includes openings 448 on this portion of the assembly. A fastener 450 includes a head 452 which passes through openings 446, 448 and openings 456 in leg 408. A nut 458 and washers 454 hold the assembly together.

The lower portion of the end slope sheet 240 and the lower portion of hopper slope sheets 258, 260, 262, 264, 266 and 268 are each formed of a wood or wood fiber body or core 460 having fiberglass facings 462 and 464. While end slope sheet 240 is illustrated in FIG. 10, it is to be born in mind that the hopper slope sheets 258, 260, 262, 264, 266 and 268 are similarly constructed. Balsa wood 460 has a foreshortened portion 468, and a transition portion 469. Facing 462 includes a transition portion 470, a first foreshortened portion 472, a second transition portion 474, and a bottom or base portion 476 wherein facing 462 abuts facing 464. The abutting fiberglass facings 464 and 462 are fabricated such that while they are applied as separate layers upon curing of the resin an integral end portion 478 results.

Appropriate fastening means 480 are provided to hold this assembly together. A Hucktainer fastener 482 extends through foreshortened balsa wood portion 468 and through facing portion 472 and through facing 464 and also through opening 413 in the frame. A Huck blind bolt fastener 484 extends through the integral portion 478 of facings 476 and 464, and through another of the openings 413 in the inclined flange portion 412.

The use of the foreshortened balsa wood portion 468 and the transition section 469 and the cooperating facing portions 470, 472, 474 and the integral facing portion 478 are desirable because of the necessity to provide the structure with a gradual increase in cross-sectional stiffness and thereby avoiding, or reducing, the effect of stress concentrations.

It should be born in mind that alternative materials are available for the end slope sheets, transverse bulkheads, and/or intermediate slope sheets. For example, honeycomb structures made of paper, metallic and/or polymeric materials may be used. Furthermore, polymeric low density foams, for example, made of polyurethane and/or polyester bond resins may be used for these members. Other lightweight construction materials for these members will be apparent to those skilled in the art.

As mentioned hereinabove, in accordance with another feature of the present invention, the filament wound car body acts as a composite box beam and is thus capable of withstanding the combined loading conditions of the lading, and longitudinal and vertical forces encountered in service. The car body may thus be considered to act as a selectively reinforced, generally cylindrically shaped composite box beam with the railway car roof and top sill section acting as a top cap, the car body sides acting as shear webs and the longitudinally extending side sills acting as bottom caps.

As a result, a portion of the longitudinal load applied to the stub sills is transmitted into the shear plate, into a vertical bolster web, into end slope sheets at either end of the car and into end bulkheads. A portion of such load is then transmitted downwardly along the top sill.

Furthermore, under impact loads in transfer yards, and under vertically and longitudinally applied coupler forces such as encountered when the train goes up and down inclines, a turning moment is applied to the vertical bolster web which is transmitted into the end slope sheet, then into the end bulkhead, and then downwardly through end diagonals extending downwardly into the shear plate.

What is claimed is:

1. A filament wound car body comprising: a filament wound car body including a pair of spaced car body sides; a pair of spaced longitudinally extending car body side sills, one for each of said car body sides, adapted to carry longitudinal loads; connecting means joining each of said car body side sills to its respective said car body side along the lower margin thereof whereby only a portion of the longitudinal loads carried by said car body sills are transmitted to said filament wound car body sides substantially entirely in shear; said car body including a pair of spaced top sills extending longitudinally of the car generally above a respective said side sill, said top sills being connected to said car body sides; said car body sides being joined by at least one transverse bulkhead intermediate the ends of said car body; a railway car roof joining said car body sides along the upper portions thereof; planar end slope sheets located at each end of the car extending between said side sills from the upper to the lower portions of the side walls; said end slope sheets joining said car sides at opposite ends of the car; and hopper slope sheets connected to said transverse bulkheads extending transversely of the car body generally below the transverse bulkheads and connected to said car body sides; said end slope sheets being of composite construction having a core and at least one face sheet secured thereto being adapted to react lading loads and coupler loads applied thereto.

2. A car body according to claim 1, wherein said end slope has a core being of a wood product.

3. A car body according to claim 1, wherein said end slope sheet has a face sheet being of fiberglass.

4. A hopper end assembly according to claim 1, wherein a vertical bolster web is integrally connected to each of said end slope sheets.

5. A filament wound car body according to claim 4 wherein a shear plate is located on a stub sill at each end of the car, and wherein portions of the longitudinal loads applied to said stub sill are transmitted to said shear plate, into said vertical bolster web, and into said end slope sheet.

6. A filament wound car body according to claim 5, wherein under impact and longitudinally applied coupler forces, a turning moment is applied to said vertical bolster web which is transmitted into said end slope sheet, into said end bulkhead and into end diagonals extending from said end slope sheets downwardly into a transversely extending shear plate.

7. A filament wound car body according to claim 6, wherein car body primary structure is capable of withstanding combined loading conditions, the lading, longitudinal and vertical forces encountered in service; said car body considered to act as a selectively reinforced, composite box beam with said railway car roof section, acting as a beam top cap; said car body sides acting as shear webs; and said longitudinally extending side sills acting as bottom cap.

* * * * *